US008152082B2

(12) United States Patent
Pan

(10) Patent No.: US 8,152,082 B2
(45) Date of Patent: Apr. 10, 2012

(54) VARIABLE FREQUENCY CONTROLLING SYSTEM AND METHOD OF SHREDDER

(75) Inventor: Yung-Tai Pan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 271 days.

(21) Appl. No.: 12/622,769

(22) Filed: Nov. 20, 2009

(65) Prior Publication Data

US 2011/0062260 A1 Mar. 17, 2011

(30) Foreign Application Priority Data

Sep. 11, 2009 (TW) ..... 98130669 A
Sep. 18, 2009 (TW) ..... 98131509 A

(51) Int. Cl.
*B02C 18/00* (2006.01)

(52) U.S. Cl. ..... 241/36

(58) Field of Classification Search ..... 241/30, 241/36

See application file for complete search history.

(56) References Cited

U.S. PATENT DOCUMENTS

| | | | | |
|---|---|---|---|---|
| 7,954,737 | B2 * | 6/2011 | Matlin et al. | 241/36 |
| 8,020,796 | B2 * | 9/2011 | Matlin et al. | 241/36 |
| 2009/0090797 | A1 * | 4/2009 | Matlin et al. | 241/28 |
| 2010/0170967 | A1 * | 7/2010 | Jensen | 241/25 |
| 2010/0170969 | A1 * | 7/2010 | Jensen et al. | 241/25 |

* cited by examiner

*Primary Examiner* — Faye Francis

(74) *Attorney, Agent, or Firm* — Kirton & McConkie; Evan R. Witt

(57) ABSTRACT

A variable frequency controlling system of a shredder is provided. The variable frequency controlling system includes a thickness sensor, a speed-variable motor and a controlling module. The controlling module is electrically connected to the speed-variable motor and the thickness sensor, and includes a look-up table. The thickness sensor is used for detecting a thickness of an article fed into the shredder. The speed-variable motor is operated at a variable rotating speed. When a thickness-detecting signal is received by the controlling module, the operating data corresponding to the thickness-detecting signal are searched from the look-up table and outputted from the controlling module to the speed-variable motor, thereby controlling the speed-variable motor to be operated at a proper rotating speed. As a consequence, a power-saving purpose is achieved by the variable frequency controlling system.

17 Claims, 5 Drawing Sheets

VARIABLE FREQUENCY CONTROLLING SYSTEM AND METHOD OF SHREDDER

FIELD OF THE INVENTION

The present invention relates to a variable frequency controlling system, and more particularly to a variable frequency controlling system of a shredder. The present invention also relates to a variable frequency controlling method for use in a shredder.

BACKGROUND OF THE INVENTION

Nowadays, shredders are widely used to cut sheet-like articles. If a relatively thick article whose thickness is beyond an acceptable range (for example a thick paper or a compact disc) is shredded by a shredder, the thick article is readily jammed. Under this circumstance, the shredder has a usage problem or even a breakdown. For avoiding the occurrence of the jamming problem, a thickness detecting mechanism is often mounted in the shredder to determine whether the article to be shredded is beyond the acceptable range.

FIG. 1 is a schematic perspective view illustrating a portion of a shredder having a thickness detecting mechanism according to the prior art. The shredder 1 includes an entrance 11, a shredding path 12, a sustaining element 13, a thickness sensing module 14, a driving motor 15, a transmission gear set 16 and a shredding knife assembly 17. The entrance 11 is disposed above the shredding path 12. The sustaining element 13 is arranged at a side of the shredding path 12. The thickness sensing module 14 is disposed behind the sustaining element 13. As shown in FIG. 1, the thickness sensing module 14 includes a light emitter 141 and a light receiver 142, which are arranged behind the sustaining element 13. The thickness sensing module 14 and the sustaining element 13 are collectively referred as a thickness detecting mechanism. The shredding knife assembly 17 is disposed at the outlet of the shredding path 12. The transmission gear set 16 is interconnected between the shredding knife assembly 17 and the driving motor 15, and engaged with the shredding knife assembly 17 and the driving motor 15. As a consequence, the shredding knife assembly 17 could be driven by the driving motor 15 to implement a shredding operation.

Hereinafter, the operations of the shredder 1 will be illustrated in more details with reference to FIG. 1. First of all, an article to be shredded (not shown) is fed into the shredding path 12 through the entrance 11. When the article is contacted with and sustained against the sustaining element 13, the sustaining element 13 is shifted backwardly to result in a shift distance with respect to its original place. In the thickness sensing module 14, the light emitter 141 continuously emits the sensing light and the sensing light is received by the light receiver 142. In a case that the sustaining element 13 fails to completely shelter the sensing light, the article is permitted to feed through the shredding path 12 so as to perform a shredding operation. Whereas, if the sensing light is completely sheltered by the sustaining element 13, the shredding operation of the shredder 1 is interrupted.

That is, in the case that the shift distance of the sustaining element 13 is not sufficient to completely shelter the sensing light emitted from the light emitter 141, it is meant that the thickness of the article is accepted by the shredder 1. Under this circumstance, the article is continuously advanced in the shredding path 12. In addition, the shredder 1 has a shredding sensor (not shown) under the sustaining element 13. When the advancing article approaches the shredding knife assembly 17, the shredding sensor will detect the presence of the article.

Meanwhile, the driving motor 105 and the transmission gear set 16 that is driven by the driving motor 105 begin to rotate. Upon rotation of the transmission gear set 16, the shredding knife assembly 17 is driven to implement a shredding operation.

As previously described, by using the sustaining element 13 and the thickness sensing module 14, the usage status of the shredder 1 may be determined according to the thickness of the article to be shredded. In other words, the sustaining element 13 and the thickness sensing module 14 are advantageous of avoiding the problem of causing jammed paper so as to extend the operating life of the shredder 1.

Nowadays, with increasing awareness of environmental protection, more and more electrical apparatuses are designed in views of power-saving concepts. The conventional shredder 1, however, still has no power-saving mechanism. For example, if a five-sheet article within the acceptable thickness range is fed into the shredding path 12, the driving motor 15 of the shredder 1 is operated at a fixed rotating speed to provide a constant torsion force to the shredding knife assembly 107. As such, the five-sheet article is shredded by the shredding knife assembly 107 with the constant torsion force. Whereas, if a two-sheet article is fed into the shredding path 12, the driving motor 15 of the shredder 1 is also operated in the fixed rotating speed to provide the constant torsion force to the shredding knife assembly 107. As such, the two-sheet article is shredded by the shredding knife assembly 107 with the constant torsion force. Since a constant torsion force is used to shred the article regardless of the sheet number of the article fed into the shredding path 12, the conventional shredder 1 may consume much power after a long-term use period. Therefore, there is a need of providing a power-saving shredder in order to obviate the problems encountered from the prior art.

SUMMARY OF THE INVENTION

An object of the present invention provides a variable frequency controlling system for use in a shredder in order to achieve a power-saving purpose.

Another object of the present invention provides a variable frequency controlling method for achieving a power-saving purpose.

In accordance with an aspect of the present invention, there is provided a variable frequency controlling system of a shredder. The variable frequency controlling system includes a thickness sensor, a speed-variable motor and a controlling module. The thickness sensor is used for detecting a thickness of an article fed into the shredder, and issuing a thickness-detecting signal according to the thickness of the article. The speed-variable motor is operated at a first rotating speed or a second rotating speed, thereby providing motive power to the shredder. The controlling module is electrically connected to the speed-variable motor and the thickness sensor, and includes a first look-up table. When the thickness-detecting signal is received by the controlling module, a motor frequency value and a motor voltage value corresponding to the thickness-detecting signal are searched from the first look-up table and outputted from the controlling module to the speed-variable motor, so that the speed-variable motor is controlled to be operated at the first rotating speed or the second rotating speed according to the motor frequency value and the motor voltage value.

In an embodiment, the first look-up table includes a first thickness value and a first motor frequency value and a first motor voltage value corresponding to the first thickness value. If the thickness of the article is equal to the first thickness value, the controlling module outputs the first motor frequency value and the first motor voltage value corresponding to the first thickness value to the speed-variable motor, so that the speed-variable motor is operated at a first motor rotating speed corresponding to the first thickness value.

In an embodiment, the first look-up table includes a second thickness value and a second motor frequency value and a second motor voltage value corresponding to the second thickness value. If the thickness of the article is equal to the second thickness value, the controlling module outputs the second motor frequency value and the second motor voltage value corresponding to the second thickness value to the speed-variable motor, so that the speed-variable motor is operated at a second motor rotating speed corresponding to the second thickness value.

In an embodiment, the second thickness value is larger than the first thickness value, and the second motor rotating speed is smaller than the first motor rotating speed.

In an embodiment, the controlling module further includes a variable frequency unit and a controlling unit. The variable frequency unit is electrically connected to an AC power source for receiving AC electricity from the AC power source and changing the frequency and voltage of the AC electricity. The controlling unit is electrically connected to the variable frequency unit and the thickness sensor for receiving the thickness-detecting signal. When the thickness-detecting signal is received by the controlling unit, the first motor frequency value and the second motor voltage value corresponding to the thickness-detecting signal are searched from the first look-up table and outputted from the controlling unit to the variable frequency unit.

In an embodiment, by the variable frequency unit, the AC electricity is converted into DC electricity, and the DC electricity is converted into three-phase AC electricity. A frequency of the three-phase AC electricity is equal to the first motor frequency value, and a voltage of the three-phase AC electricity is equal to the first motor voltage value.

In an embodiment, the variable frequency controlling system further includes a motor monitoring module, which is electrically connected to the controlling module and the speed-variable motor for monitor performance of the speed-variable motor. The motor monitoring module includes a temperature sensor for detecting an actual temperature of the speed-variable motor, a rotating speed sensor for detecting an actual rotating speed of the speed-variable motor, and a current sensor for detecting an actual current of the speed-variable motor.

In an embodiment, if a predetermined operating speed of the speed-variable motor is controlled to be equal to the first motor rotating speed value but the actual operating speed of the speed-variable motor detected by the rotating speed sensor is larger or smaller than the first motor rotating speed value, the rotating speed sensor issues a rotating speed compensating signal to the controlling module so as to decrease or increase the actual operating speed of the speed-variable motor.

In an embodiment, the first motor rotating speed value is listed in the first look-up table.

In an embodiment, the current sensor has a permissible error. If a predetermined current of the speed-variable motor is controlled to be equal to a first motor current value but the difference between the actual current of the speed-variable motor detected by the current sensor and the first motor current value is larger than the permissible error, the current sensor issues a current detecting signal to warn a user.

In an embodiment, the first motor current value is listed in the first look-up table.

In an embodiment, if the actual temperature of the speed-variable motor is larger or equal to a predetermined temperature value, the temperature sensor issues a disabling signal to the controlling module. The speed-variable motor is disabled under control of the controlling module in response to the disabling signal.

In an embodiment, the variable frequency controlling system further includes a feeding-article sensor, which is connected to the controlling module for detecting whether the article is fed into the shredder. When the article is fed into the shredder, the feeding-article sensor issues an initiating signal to the controlling module. In response to the initiating signal the controlling module starts to receive the thickness-detecting signal from the thickness sensor.

In an embodiment, the variable frequency controlling system further includes a mode-switching element, which is manipulated to switch the shredder between a first mode and a second mode. The controlling module includes a second look-up table corresponding to the second mode. The second look-up table includes a preset motor frequency value and a preset motor voltage value corresponding to the thickness-detecting signal. If the shredder is switched to the second mode, the controlling module outputs the preset motor frequency value and the preset motor voltage value to the speed-variable motor by referring to the second look-up table, so that the speed-variable motor is operated at a preset motor rotating speed.

In an embodiment, the first mode is a power-saving mode, and the second mode is a high-speed mode. A first preset motor frequency value, a first preset motor voltage value and a first preset motor rotating speed corresponding to the high-speed mode are respectively a first high-speed motor frequency value, a first high-speed motor voltage value and a first high-speed motor rotating speed. The first motor rotating speed is smaller than the first high-speed motor rotating speed.

In an embodiment, the first mode is a power-saving mode, and the second mode is a silent mode. A first preset motor frequency value, a first preset motor voltage value and a first preset motor rotating speed corresponding to the silent mode are respectively a first silent motor frequency value, a first silent motor voltage value and a first silent motor rotating speed. The first motor rotating speed is larger than the first silent motor rotating speed.

In an embodiment, the first mode is a high-speed mode, and the second mode is a silent mode. A first motor frequency value, a first motor voltage value and a first motor rotating speed corresponding to the high-speed mode are respectively a first high-speed motor frequency value, a first high-speed motor voltage value and a first high-speed motor rotating speed, a first preset motor frequency value. A first preset motor voltage value and a first preset motor rotating speed corresponding to the silent mode are respectively a first silent motor frequency value, a first silent motor voltage value and a first silent motor rotating speed. The first high-speed motor rotating speed is larger than the first silent motor rotating speed.

In an embodiment, the mode-switching element is switched from the first mode or the second mode to a third mode, the first mode is a power-saving mode, the second mode is a high-speed mode, and the third mode is a silent mode. A first preset motor frequency value, a first preset motor voltage value and a first preset motor rotating speed corresponding to the high-speed mode are respectively a first high-speed motor frequency value, a first high-speed motor voltage value and a first high-speed motor rotating speed. A first preset motor frequency value, a first preset motor voltage value and a first preset motor rotating speed corresponding to the silent mode are respectively a first silent motor frequency value, a first silent motor voltage value and a first silent motor rotating speed. The first silent motor rotating speed is smaller than the first motor rotating speed. The first motor rotating speed is smaller than the first high-speed motor rotating speed.

In accordance with another aspect of the present invention, there is provided a variable frequency controlling method for controlling a shredding speed of a shredder. The shredder includes a thickness sensor, a speed-variable motor and a first look-up table. The first look-up table includes plural thickness values and plural motor frequency values and plural motor voltage values corresponding to the plural thickness values. The variable frequency controlling method includes steps of detecting a thickness of an article fed into the shredder by the thickness sensor, searching a first thickness value corresponding to the thickness of the article from the plural thickness values of the first look-up table, searching a first motor frequency value and a first motor voltage value corresponding to the first thickness value from the plural motor frequency values and the plural motor voltage values of the first look-up table, and transmitting the first motor frequency value and the first motor voltage value to the speed-variable motor, thereby controlling the speed-variable motor to be operated at a first motor rotating speed.

In an embodiment, if the thickness of the article is equal to a second thickness value of the plural thickness values, a second motor frequency value and a second motor voltage value corresponding to the second thickness value are searched from the first look-up table, so that the speed-variable motor is operated at a second motor rotating speed according to the second motor frequency value and the second motor voltage value. The second thickness value is larger than the first thickness value, and the second motor rotating speed is lower than the first motor rotating speed.

In accordance with a further aspect of the present invention, there is provided a variable frequency controlling method for controlling a shredding speed of a shredder. The shredder includes a thickness sensor, a speed-variable motor, a first look-up table and a second look-up table. The first look-up table includes plural thickness values and plural motor frequency values and plural motor voltage values corresponding to the plural thickness values. The second look-up table includes plural thickness values and plural preset motor frequency values and plural preset motor voltage values corresponding to the plural thickness values. Firstly, the shredder is selected to be operated in a first mode or a second mode. If the shredder is operated in the first mode, the first look-up table is used. Whereas, if the shredder is operated in the second mode, the second look-up table is used. Then, a thickness of an article fed into the shredder is detected by the thickness sensor. Then, a first thickness value corresponding to the thickness of the article is searched from the plural thickness values of the first look-up table or the second look-up table. Then, a first motor frequency value and a first motor voltage value corresponding to the first thickness value are searched from the first look-up table, or a first preset motor frequency value and a first preset motor voltage value corresponding to the first thickness value are searched from the second look-up table. Afterwards, the first motor frequency value and the first motor voltage value or the first preset motor frequency value and the first preset motor voltage value are transmitted to the speed-variable motor, thereby controlling the speed-variable motor to be operated at a first motor rotating speed or a first preset motor rotating speed.

In an embodiment, the first mode is a power-saving mode, and the second mode is a high-speed mode. The first preset motor frequency value, the first preset motor voltage value and the first preset motor rotating speed corresponding to the high-speed mode are respectively a first high-speed motor frequency value, a first high-speed motor voltage value and a first high-speed motor rotating speed. The first motor rotating speed is smaller than the first high-speed motor rotating speed.

In an embodiment, the first mode is a power-saving mode, and the second mode is a silent mode. The first preset motor frequency value, the first preset motor voltage value and the first preset motor rotating speed corresponding to the silent mode are respectively a first silent motor frequency value, a first silent motor voltage value and a first silent motor rotating speed. The first motor rotating speed is larger than the first silent motor rotating speed.

In an embodiment, the first mode is a high-speed mode, and the second mode is a silent mode. The first motor frequency value, the first motor voltage value and the first motor rotating speed corresponding to the high-speed mode are respectively a first high-speed motor frequency value, a first high-speed motor voltage value and a first high-speed motor rotating speed. The first preset motor frequency value, the first preset motor voltage value and the first preset motor rotating speed corresponding to the silent mode are respectively a first silent motor frequency value, a first silent motor voltage value and a first silent motor rotating speed. The first high-speed motor rotating speed is larger than the first silent motor rotating speed.

In an embodiment, the shredder is further permitted to be operated in a third mode. The first mode is a power-saving mode, the second mode is a high-speed mode, and the third mode is a silent mode. The first preset motor frequency value, the first preset motor voltage value and the first preset motor rotating speed corresponding to the high-speed mode are respectively a first high-speed motor frequency value, a first high-speed motor voltage value and a first high-speed motor rotating speed. The first preset motor frequency value, the first preset motor voltage value and the first preset motor rotating speed corresponding to the silent mode are respectively a first silent motor frequency value, a first silent motor voltage value and a first silent motor rotating speed. The first silent motor rotating speed is smaller than the first motor rotating speed. The first motor rotating speed is smaller than the first high-speed motor rotating speed.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

As previously described, since the conventional shredder has no power-saving mechanism, the power consumption is usually considerable. For obviating the problems encountered from the prior art, the present invention provides a variable frequency controlling system and a variable frequency controlling method for use in a shredder. In accordance with the variable frequency controlling method of the present invention, the thickness of the article to be fed into the shredder is detected, and the rotating speed of the motor is increased or decreased according to the thickness of the article. As a consequence, the variable frequency controlling method could achieve a power-saving purpose.

Figure 1:
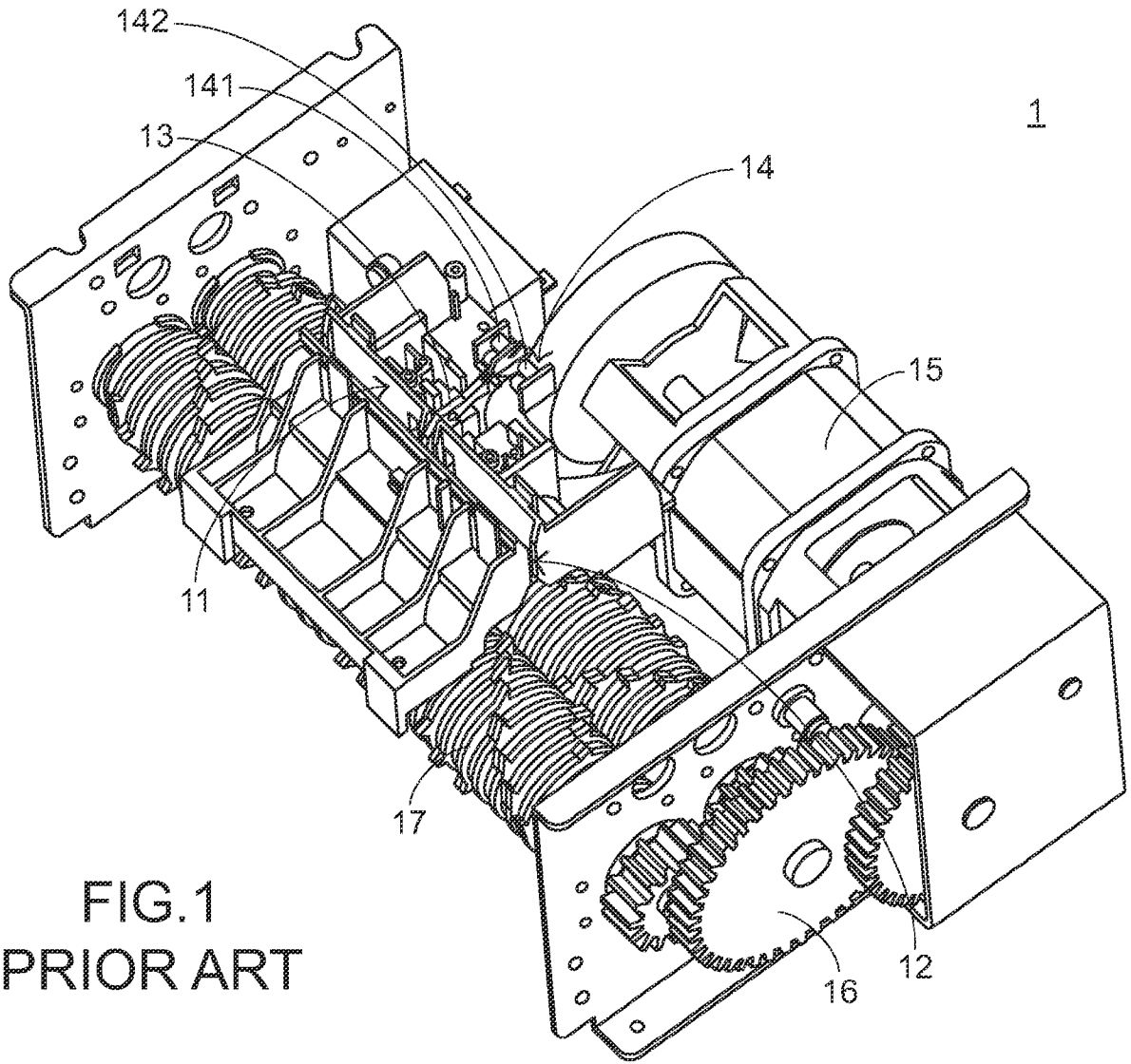
FIG.1 PRIOR ART
FIG. 1 is a schematic perspective view illustrating a portion of a shredder having a thickness detecting mechanism according to the prior art.
Figure 2:
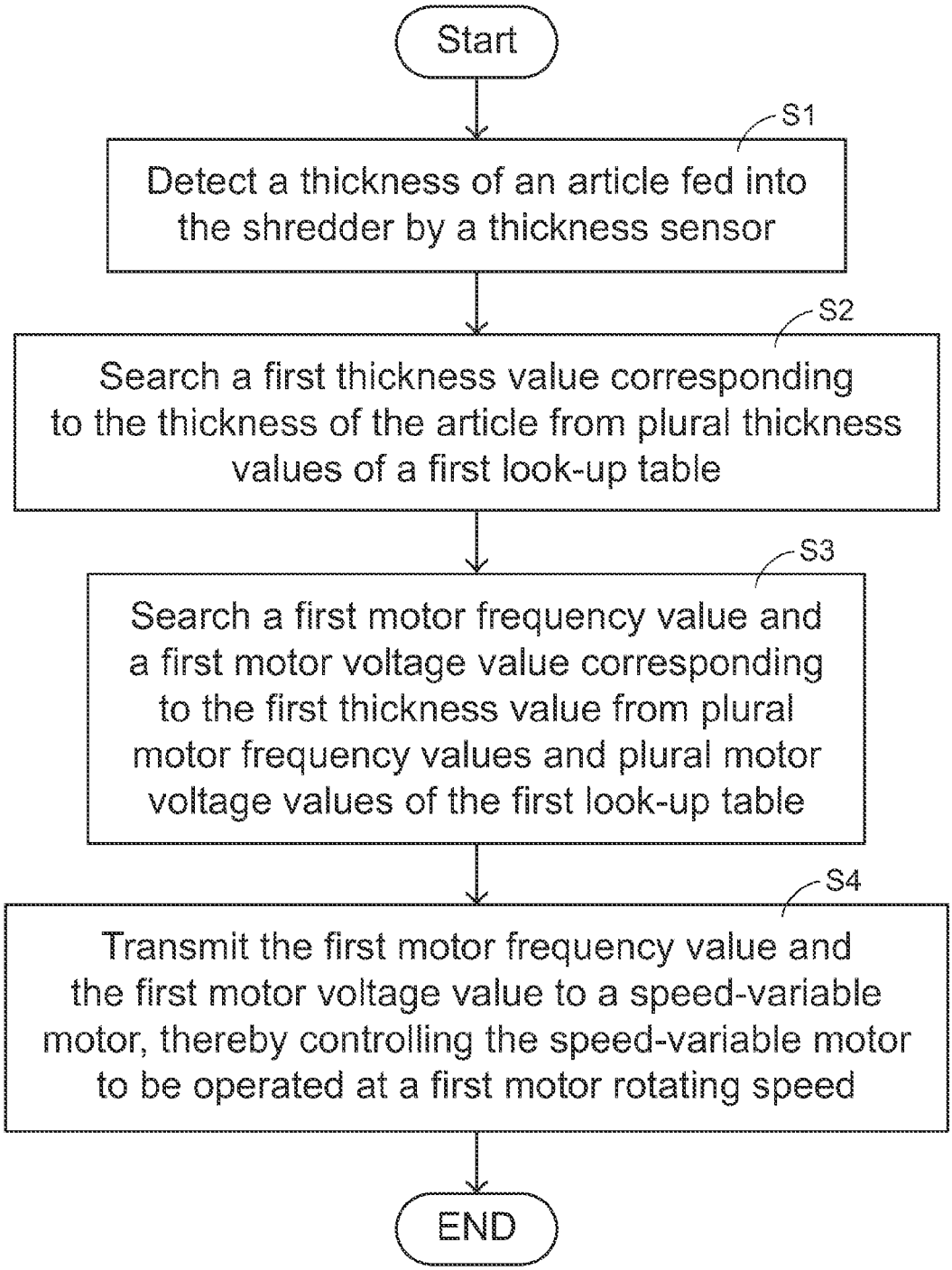
FIG. 2 is a flowchart illustrating a variable frequency controlling method according to a first embodiment of the present invention.

FIG. 2 is a flowchart illustrating a variable frequency controlling method according to a first embodiment of the present invention. First of all, a thickness of an article fed into the shredder is detected by a thickness sensor (Step S1). Next, a first thickness value corresponding to the thickness of the article is searched from plural thickness values of a first look-up table (Step S2). Next, a first motor frequency value and a first motor voltage value corresponding to the first thickness value are searched from plural motor frequency values and plural motor voltage values of the first look-up table (Step S3). The first motor frequency value and the first motor voltage value are transmitted to a speed-variable motor, thereby controlling the speed-variable motor to be operated at a first motor rotating speed (Step S4). It is found, from the flowchart of FIG. 2, that the variable frequency controlling method of the present invention could control the rotating speed of the speed-variable motor by searching a motor frequency value and a motor voltage value corresponding to the thickness of the article from the first look-up table.

Figure 3:
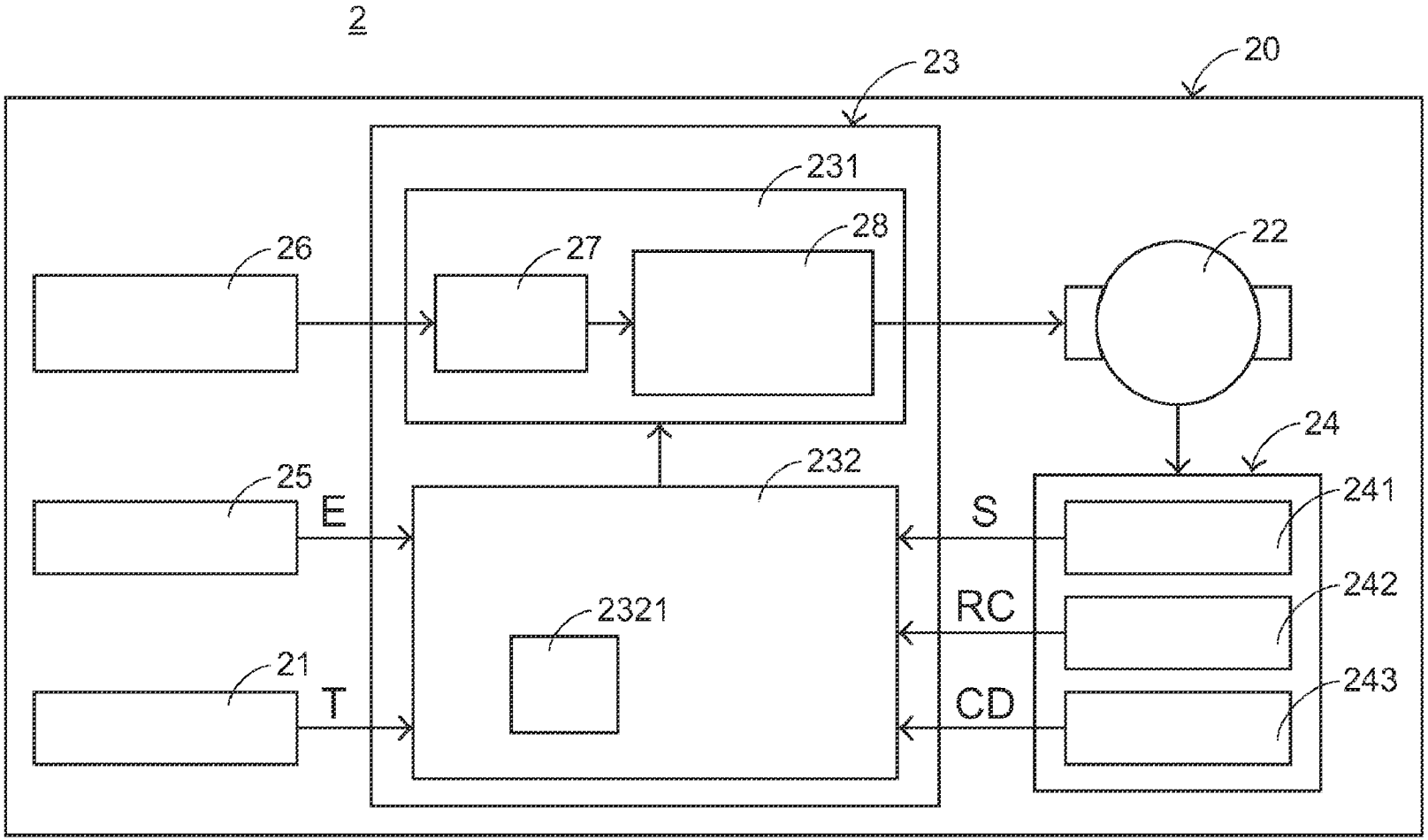
FIG. 3 is a schematic functional block diagram illustrating a variable frequency controlling system of a shredder according to the first embodiment of the present invention.

FIG. 3 is a schematic functional block diagram illustrating a variable frequency controlling system of a shredder according to the first embodiment of the present invention. The variable frequency controlling system 20 of the shredder 2 comprises a thickness sensor 21, a speed-variable motor 22 and a controlling module 23. The thickness sensor 21 is electrically connected to the controlling module 23 for detecting a thickness of an article (not shown) fed into the shredder 2. According to the thickness of the article, the thickness sensor 21 issues a thickness-detecting signal T to the controlling module 23. The speed-variable motor 22 is operated at a first rotating speed or a second rotating speed, thereby providing motive power to the shredder 2. In this embodiment, the speed-variable motor 22 is three-phase AC motor. The controlling module 23 is electrically connected to the speed-variable motor 22 and the thickness sensor 21. The controlling module 23 has a first look-up table 2321. When the thickness-detecting signal T is received by the controlling module 23, a motor frequency value and a motor voltage value corresponding to the thickness-detecting signal T are searched from the first look-up table 2321. Then, the motor frequency value and the motor voltage value are outputted from the controlling module 23 to the speed-variable motor 22. Under control of the controlling module 23, the speed-variable motor 22 is operated at the first rotating speed or the second rotating speed according to the motor frequency value and the motor voltage value.

In this embodiment, the controlling module 23 comprises a variable frequency unit 231 and a controlling unit 232. The variable frequency unit 231 is electrically connected to an AC power source 26 for receiving AC electricity from the AC power source 26 and changing the frequency and voltage of the AC electricity. The controlling unit 232 is electrically connected to the variable frequency unit 231 and the thickness sensor 21 for receiving the thickness-detecting signal T. When the thickness-detecting signal T is received by the controlling unit 232, a motor frequency value and a motor voltage value corresponding to the thickness-detecting signal T are searched from the first look-up table 2321. Then, the motor frequency value and the motor voltage value are outputted from the controlling unit 232 to the variable frequency unit 231. An example of the variable frequency unit 231 is a digital signal processor (DSP). The first look-up table 2321 contains some operating data of the speed-variable motor 22. The exemplary contents of the first look-up table 2321 will be illustrated as follows.

| | Motor frequency value | Motor voltage value | Motor current value | Motor rotating speed value |
|---|---|---|---|---|
| 1 | $F_1$ | $V_1$ | $I_1$ | $RPM_1$ |
| 2 | $F_2$ | $V_2$ | $I_2$ | $RPM_2$ |
| 3 | $F_3$ | $V_3$ | $I_3$ | $RPM_3$ |
| 4 | $F_4$ | $V_4$ | $I_4$ | $RPM_4$ |
| N | $F_N$ | $V_N$ | $I_N$ | $RPM_N$ |

In this embodiment, the first column of the first look-up table 2321 lists the predetermined numbers of sheets that are indicative of the overall thickness of the article to be shredded. Alternatively, the first column of the first look-up table 2321 lists the numbers of thickness units (e.g. millimeter) that are indicative of the overall thickness of the article to be shredded. Please refer to the first look-up table 2321. In a case that the number of sheets is 1, the operating data of the speed-variable motor 22 includes a first motor frequency value $F_1$, a first motor voltage value $V_1$, a first motor current value $I_1$, and a first motor rotating speed value $RPM_1$. In a case that the number of sheets is 2, the operating data of the speed-variable motor 22 includes a second motor frequency value $F_2$, a second motor voltage value $V_2$, a second motor current value $I_2$, and a second motor rotating speed value $RPM_2$. The rest may be deduced by analogy. In the first look-up table 2321, the first motor frequency value $F_1$ is larger than the $N^{th}$ motor frequency value $F_N$, and the first motor rotating speed value $RPM_1$ is larger than the $N^{th}$ motor rotating speed value $RPM_N$. The operating data listed in the first look-up table 2321 are obtained by undue experiments. Since the speed-variable motor 22 is operated according to the operating data listed in the first look-up table 2321, the shredder 2 could shred the article while achieving the power-saving purpose.

In the variable frequency controlling system 20, the operating data of the speed-variable motor 22 are acquired from the first look-up table 2321 according to the overall thickness of the article to be shredded, and the motor frequency value and the motor voltage value are outputted to the speed-variable motor 22. In accordance with the key feature of the present invention, the speed-variable motor 22 is operated at a rotating speed acquired from the first look-up table 2321 through the controlling module 23. For discriminating whether the operating condition of the speed-variable motor 22 is normal, the variable frequency controlling system 20 further comprises a motor monitoring module 24 to monitor the performance of the speed-variable motor 22. As shown in FIG. 3, the motor monitoring module 24 comprises a temperature sensor 241, a rotating speed sensor 242 and a current sensor 243. The temperature sensor 241 is used for detecting the temperature of the speed-variable motor 22. The rotating speed sensor 242 is used for detecting the rotating speed of the speed-variable motor 22. The current sensor 243 is used for detecting the current of the speed-variable motor 22.

Moreover, the variable frequency controlling system 20 further comprises a feeding-article sensor 25. The article feeding sensor 25 is electrically connected to the controlling module 23 for detecting whether the article to be shredded is fed into the shredder 2. When the article to be shredded is fed into the shredder 2, the feeding-article sensor 25 issues an initiating signal E to the controlling module 23. In response to the initiating signal E, the controlling module 23 starts to receive the thickness-detecting signal T from the thickness sensor 21. By means of the feeding-article sensor 25, the controlling module 23 could confirm that the thickness-detecting signal T transmitted from the thickness sensor 21 is generated when the thickness of the article to be shredded is detected by the thickness sensor 21. In addition, the feeding-article sensor 25 could discriminate whether the article is exited from the shredder 2. After the article is exited from the shredder 2, the thickness sensor 21 is zeroed to detect the thickness of a next article to be shredded.

Hereinafter, the operations of the variable frequency controlling system 20 of the shredder 2 will be illustrated in more details with reference to FIG. 3. First of all, an article to be shredded is fed into the shredder. When the article is detected by the feeding-article sensor 25, the feeding-article sensor 25 issues an initiating signal E to the controlling unit 232 of the controlling module 23. Meanwhile, the controlling unit 232 starts to receive the thickness-detecting signal T from the thickness sensor 21. On the other hand, when the thickness of the article is detected by the thickness sensor 21, the thickness sensor 21 issues the thickness-detecting signal T. Assuming that the thickness of the article is equal to the thickness of a single sheet, the thickness-detecting signal T includes the thickness information associated with the single-sheet article. When the thickness-detecting signal T is received by the controlling unit 232, the motor frequency value and the motor voltage value corresponding to the thickness information (i.e. the number of sheets is 1) of the thickness-detecting signal T are searched from the first look-up table 2321. That is, the operating data of the speed-variable motor 22 includes the first motor frequency value $F_1$, the first motor voltage value $V_1$, the first motor current value $I_1$, and the first motor rotating speed value $RPM_1$. As such, the first motor frequency value $F_1$ and the first motor voltage value $V_1$ are outputted from the controlling unit 232 to the variable frequency unit 231.

In addition to the first motor frequency value $F_1$ and the first motor voltage value $V_1$, the variable frequency unit 231 also receives the AC electricity from the AC power source 26. By the variable frequency unit 231, the AC electricity is converted into DC electricity 27, and the DC electricity 27 is converted into three-phase AC electricity 28. The frequency and the voltage of the three-phase AC electricity 28 are equal to the first motor frequency value $F_1$ and the first motor voltage value $V_1$, respectively. The three-phase AC electricity 28 is then transmitted to the speed-variable motor 22, so that the speed-variable motor 22 is operated at the first motor rotating speed value $RPM_1$.

Similarly, assuming that the thickness of the article is equal to the thickness of two sheets, the thickness-detecting signal T includes the thickness information associated with the two-sheet article. When the thickness-detecting signal T is received by the controlling unit 232, the motor frequency value and the motor voltage value corresponding to the thickness information (i.e. the number of sheets is 2) of the thickness-detecting signal T are searched from the first look-up table 2321. That is, the operating data of the speed-variable motor 22 includes the second motor frequency value $F_2$, the second motor voltage value $V_2$, the second motor current value $I_2$, and the second motor rotating speed value $RPM_2$. The second motor frequency value $F_2$ and the second motor voltage value $V_2$ are outputted from the controlling unit 232 to the variable frequency unit 231, so that the speed-variable motor 22 is operated at the second motor rotating speed value $RPM_2$.

During the operation of the speed-variable motor 22, the rotating speed sensor 242 and the current sensor 243 of the motor monitoring module 24 monitor whether the operating data of the speed-variable motor 22 comply with corresponding operating data of the first look-up table 2321. If the speed-variable motor 22 is controlled to be operated at the first motor rotating speed value $RPM_1$ by the controlling unit 232 of the controlling module 23 but the actual rotating speed of the speed-variable motor 22 detected by the rotating speed sensor 242 is larger than the first motor rotating speed value $RPM_1$, the rotating speed sensor 242 issues a rotating speed compensating signal RC to the controlling unit 232. In response to the rotating speed compensating signal RC, the controlling unit 232 will decrease the rotating speed of the speed-variable motor 22 such that the rotating speed of the speed-variable motor 22 is equal to the first motor rotating speed value $RPM_1$. On the other hand, if the actual rotating speed of the speed-variable motor 22 detected by the rotating speed sensor 242 is smaller than the first motor rotating speed value $RPM_1$, the controlling unit 232 will increase the rotating speed of the speed-variable motor 22 such that the rotating speed of the speed-variable motor 22 is equal to the first motor rotating speed value $RPM_1$. In other words, the use of the rotating speed sensor 242 results in a close loop control system of controlling the rotating speed of the speed-variable motor 22.

The current sensor 243 is used for detecting the current of the speed-variable motor 22 and discriminating whether the current of the speed-variable motor 22 is equal to a first motor current value $I_1$. The current sensor 243 has a permissible error. In this embodiment, the permissible error is plus or minus 10%. If the difference between the current detected by the current sensor 243 and the first motor current value $I_1$ exceeds 10% of the first motor current value $I_1$, the current sensor 243 issues a current detecting signal CD to the controlling unit 232 so as to notify the user that the operation of the speed-variable motor 22 is abnormal.

The controlling unit 232 further comprises a predetermined temperature value. The temperature of the speed-variable motor 22 larger than or equal to the predetermined temperature value indicates that the speed-variable motor 22 is overheated and the operation of the speed-variable motor 22 should be interrupted. For protecting the speed-variable motor 22 from burning down due to overheat, the temperature sensor 241 of the motor monitoring module 24 needs to continuously monitor the temperature of the speed-variable motor 22 during the speed-variable motor 22 is operated. If the temperature of the speed-variable motor 22 is larger than or equal to the predetermined temperature value, the temperature sensor 241 issues a disabling signal S to the controlling unit 232 of the controlling module 23. In response to the disabling signal S, the controlling unit 232 will stop operation of the speed-variable motor 22.

In other words, the use of the temperature sensor 241 of the motor monitoring module 24 could protect the speed-variable motor 22; and the uses of the rotating speed sensor 242 and the current sensor 243 allow the operating data of the speed-variable motor 22 to comply with corresponding operating data of the first look-up table 2321.

From the above embodiment, the variable frequency controlling system and the variable frequency controlling method could control the speed-variable motor 22 to operate according to the operating data listed in the first look-up table 2321 in order to reduce waste of power. For providing more benefits, numerous modifications and alterations of the variable frequency controlling system and the variable frequency controlling method according to the present invention may be made while retaining the teachings of the invention.

Figure 4:
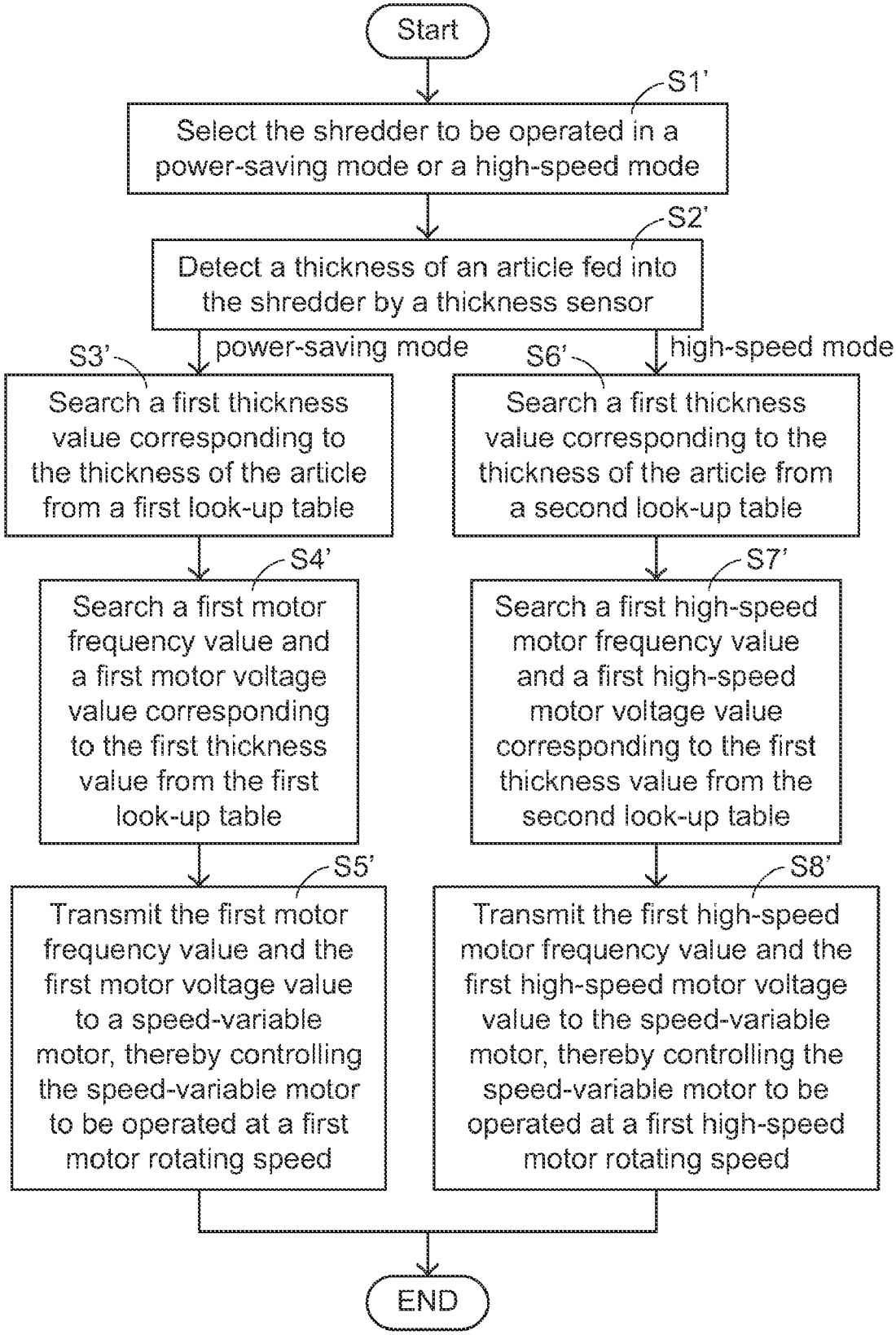
FIG. 4 is a flowchart illustrating a variable frequency controlling method according to a second embodiment of the present invention.

FIG. 4 is a flowchart illustrating a variable frequency controlling method according to a second embodiment of the present invention. First of all, the shredder is selected to be operated in a power-saving mode or a high-speed mode (Step S1'). Next, a thickness of an article fed into the shredder is detected by a thickness sensor (Step S2'). In a case that the shredder is operated in the power-saving mode, a first thickness value corresponding to the thickness of the article is searched from a first look-up table (Step S3'). Next, a first motor frequency value and a first motor voltage value corresponding to the first thickness value are searched from the first look-up table (Step S4'). The first motor frequency value and the first motor voltage value are transmitted to a speed-variable motor, thereby controlling the speed-variable motor to be operated at a first motor rotating speed (Step S5'). Meanwhile, the power-saving mode is terminated.

In a case that the shredder is operated in the high-speed mode, a first thickness value corresponding to the thickness of the article is searched from a second look-up table (Step S6'). Next, a first high-speed motor frequency value and a first high-speed motor voltage value corresponding to the first thickness value are searched from the second look-up table (Step S7'). The first high-speed motor frequency value and the first high-speed motor voltage value are transmitted to the speed-variable motor, thereby controlling the speed-variable motor to be operated at a first high-speed motor rotating speed (Step S8'). Meanwhile, the high-speed mode is terminated.

By the variable frequency controlling method of the second embodiment, the shredder could be operated in the power-saving mode or the high-speed mode according to practical requirements, thereby achieving a power-saving or time-saving purpose.

Figure 5:
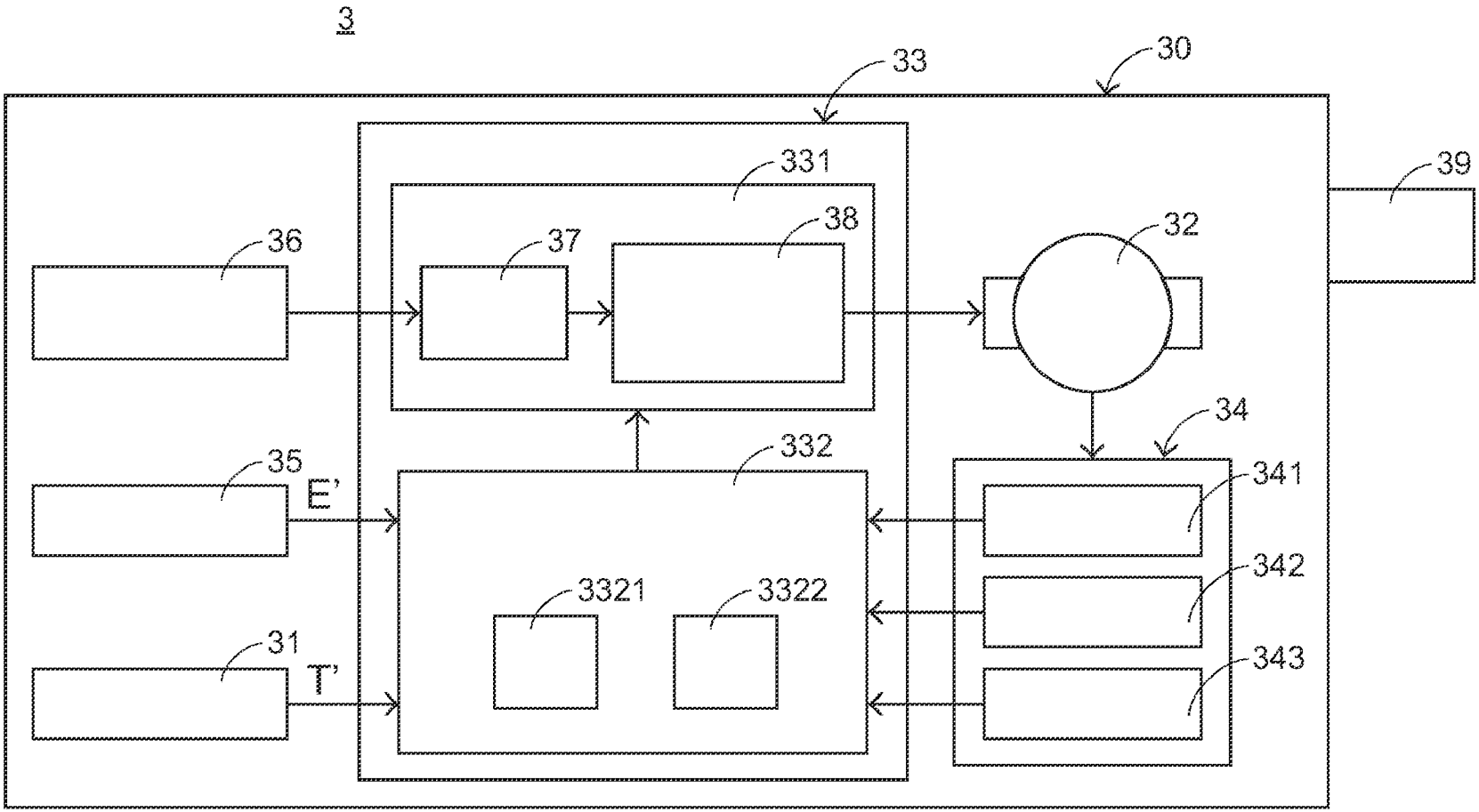
FIG. 5 is a schematic functional block diagram illustrating a variable frequency controlling system of a shredder according to the second embodiment of the present invention.

FIG. 5 is a schematic functional block diagram illustrating a variable frequency controlling system of a shredder according to the second embodiment of the present invention. The variable frequency controlling system 30 of the shredder 3 comprises a thickness sensor 31, a speed-variable motor 32, a controlling module 33, a motor monitoring module 34, a feeding-article sensor 35, and a mode-switching element 39. Except that the variable frequency controlling system 30 further comprises the mode-switching element 39, the configurations of the variable frequency controlling system 30 are substantially identical to those of the variable frequency controlling system 20 of the first embodiment, and are not redundantly described herein. By manipulating the mode-switching element 39, the shredder 3 could be switched from a power-saving mode to a high-speed mode or from the high-speed mode to the power-saving mode. In a case that the shredder 3 is switched from the high-speed mode to the power-saving mode, the controlling module 33 searches a motor frequency value and a motor voltage value corresponding to the thickness of the article from a first look-up table 3321 (the contents of the first look-up table 3321 are the same as those of the first look-up table 2321) and outputs the motor frequency value and the motor voltage value and the speed-variable motor 32. Moreover, the controlling unit 322 of the controlling module 33 of the variable frequency controlling system 30 further comprises a second look-up table 3322. The second look-up table 3322 contains some operating data of the speed-variable motor 32 in the high-speed mode. The exemplary contents of the second look-up table 3322 will be illustrated as follows.

| | High-speed motor frequency value | High-speed motor voltage value | High-speed motor current value | High-speed motor rotating speed value |
|---|---|---|---|---|
| 1 | $F_1$* | $V_1$* | $I_1$* | $RPM_1$* |
| 2 | $F_2$* | $V_2$* | $I_2$* | $RPM_2$* |
| 3 | $F_3$* | $V_3$* | $I_3$* | $RPM_3$* |
| 4 | $F_4$* | $V_4$* | $I_4$* | $RPM_4$* |
| N | $F_N$* | $V_N$* | $I_N$* | $RPM_N$* |

Please refer to the second look-up table 3322. In a case that the number of sheets is 1, the operating data of the speed-variable motor 22 includes a first high-speed motor frequency value $F_1$*, a first high-speed motor voltage value $V_1$*, a first high-speed motor current value $I_1$*, and a first high-speed motor rotating speed value $RPM_1$*. In a case that the number of sheets is 3, the operating data of the speed-variable motor 22 includes a third high-speed motor frequency value $F_3$*, a third high-speed motor voltage value $V_3$*, a third high-speed motor current value $I_3$*, and a third high-speed motor rotating speed value $RPM_3$*. The rest may be deduced by analogy. In the second look-up table 3322, the first high-speed motor frequency value $F_1$* is larger than the $N^{th}$ high-speed motor frequency value $F_N$*, and the first high-speed motor rotating speed value $RPM_1$* is larger than the $N^{th}$ high-speed motor rotating speed value $RPM_N$*. In comparison with the first look-up table 3321, the first high-speed motor rotating speed value $RPM_1$* is larger than the first motor rotating speed value $RPM_1$, and the $N^{th}$ high-speed motor rotating speed value $RPM_N$* is larger than the $N^{th}$ motor rotating speed value $RPM_N$. The operating data listed in the second look-up table 3322 are obtained by undue experiments. As such, the speed-variable motor 22 of the shredder 3 could be operated at a high speed according to the operating data listed in the second look-up table 3322.

Hereinafter, the operations of the variable frequency controlling system 30 of the shredder 3 will be illustrated in more details with reference to FIG. 5. First of all, the shredder is operated in the power-saving mode, and an article to be shredded (not shown) is fed into the shredder 3. When the article is detected by the feeding-article sensor 35, the feeding-article sensor 35 issues an initiating signal E' to the controlling unit 332 of the controlling module 33. Meanwhile, the controlling unit 332 starts to receive the thickness-detecting signal T' from the thickness sensor 31. Assuming that the thickness of the article is equal to the thickness of a single sheet, the thickness-detecting signal T' includes the thickness information associated with the single-sheet article. When the thickness-detecting signal T' is received by the controlling unit 332, the motor frequency value and the motor voltage value corresponding to the thickness information (i.e. the number of sheets is 1) of the thickness-detecting signal T' are searched from the first look-up table 3321. As such, the first motor frequency value $F_1$ and the first motor voltage value $V_1$ are outputted from the controlling unit 332 to the variable frequency unit 331.

Moreover, the variable frequency unit 331 also receives the AC electricity from the AC power source 36. By the variable frequency unit 331, the AC electricity is converted into DC electricity 37, and the DC electricity 37 is converted into three-phase AC electricity 38. The frequency and the voltage of the three-phase AC electricity 38 are equal to the first motor frequency value $F_1$ and the first motor voltage value $V_1$, respectively. The three-phase AC electricity 38 is then transmitted to the speed-variable motor 32, so that the speed-variable motor 32 is operated at the first motor rotating speed value $RPM_1$.

In a case that the user intends to quickly shred the article, the shredder 3 could be switched from the power-saving mode to the high-speed mode by manipulating the mode-switching element 39. Assuming that a three-sheet article is fed into the shredded 3, the article is detected by the feeding-article sensor 35 and the feeding-article sensor 35 issues an initiating signal E' to the controlling unit 332 of the controlling module 33. Meanwhile, the controlling unit 332 starts to receive the thickness-detecting signal T' from the thickness sensor 31. The thickness-detecting signal T' includes the thickness information associated with the three-sheet article. When the thickness-detecting signal T' is received by the controlling unit 332, the motor frequency value and the motor voltage value corresponding to the thickness information (i.e. the number of sheets is 3) of the thickness-detecting signal T' are searched from the second look-up table 3322. As such, the third high-speed motor frequency value $F_3$* and the third high-speed motor voltage value $V_3$* are outputted from the controlling unit 332 to the variable frequency unit 331. By the variable frequency unit 331, the AC electricity is converted into DC electricity 37, and the DC electricity 37 is converted into three-phase AC electricity 38. The frequency and the voltage of the three-phase AC electricity 38 are equal to the third high-speed motor frequency value $F_3$* and the third high-speed motor voltage value $V_3$*, respectively. The three-phase AC electricity 38 is then transmitted to the speed-variable motor 32, so that the speed-variable motor 32 is operated at the third high-speed motor rotating speed value $RPM_3$*.

During operation of the speed-variable motor 32, the temperature sensor 341, a rotating speed sensor 342 and the current sensor 343 of the motor monitoring module 34 monitor whether the operating data of the motor monitoring module 34 comply with corresponding operating data of the first look-up table 3321 or the second look-up table 3322. The principles of monitoring the speed-variable motor 32 by the motor monitoring module 34 are identical to those illustrated in the first embodiment, and are not redundantly described herein. In this embodiment, the first mode is a power-saving mode and the second mode is a high-speed mode. Nevertheless, the first mode and the second mode could be selected from other modes.

Recently, a small and light shredder is widely used in the office. Since the small and light shredder usually generates loud noise during its operation, the persons in the office are usually suffered from hearing diseases due to the noise. For solving this problem, the variable frequency controlling system of the present invention further provides a third embodiment. Except that the shredder could be further operated in a third mode, the configurations of the variable frequency controlling system of the third embodiment are substantially identical to those of the variable frequency controlling system of the second embodiment, and are not redundantly described herein. The third mode is a silent mode. A third look-up table contains some operating data of the speed-variable motor 32 in the silent mode. The operating data of the speed-variable motor 32 in the silent mode includes plural motor frequency values, plural motor voltage values, plural motor current values, and plural motor rotating speed values. The exemplary contents of the third look-up table will be illustrated as follows.

| | Silent motor frequency value | Silent motor voltage value | Silent motor current value | Silent motor rotating speed value |
|---|---|---|---|---|
| 1 | $F_1'$ | $V_1'$ | $I_1'$ | $RPM_1'$ |
| 2 | $F_2'$ | $V_2'$ | $I_2'$ | $RPM_2'$ |
| 3 | $F_3'$ | $V_3'$ | $I_3'$ | $RPM_3'$ |
| 4 | $F_4'$ | $V_4'$ | $I_4'$ | $RPM_4'$ |
| N | $F_N'$ | $V_N'$ | $I_N'$ | $RPM_N'$ |

Since the first silent motor rotating speed value $RPM_1'$ is slower than the first motor rotating speed value $RPM_1$ the noise generated by the speed-variable motor is very tiny. By the variable frequency controlling system of a shredder, the silent motor frequency value and the silent motor voltage value are adjusted. As such, the speed-variable motor is operated at a slower operating speed (i.e. a silent motor rotating speed) while providing a proper torsion force to shed the article.

From the above description, the variable frequency controlling system and the variable frequency controlling method of the shredder according to the present invention could provide proper motive power to the speed-variable motor according to the thickness of the article to be shredded. That is, the speed-variable motor is operated at a proper rotating speed so as to achieve the power-saving purpose. The variable frequency controlling system has a look-up table. By detecting the thickness of the article and referring the look-up table, the variable frequency controlling system is effective to control rotating speed of the speed-variable motor. Without the need of computing the thickness of the article, the control unit could provide proper motive power to the speed-variable motor. In other words, since the computing time is not necessary for the variable frequency controlling system of the present invention, a low-level control unit is feasible.

In addition to the power-saving efficacy, the variable frequency controlling system of the present invention also allows the shredder to be operated in a high-speed mode. As such, the speed-variable motor could be operated at a highest rotating speed within the allowable range in order to achieve a time-saving purpose. When compared with the prior art, the shredder of the present invention could save much power source.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A variable frequency controlling system of a shredder, said variable frequency controlling system comprising:

a thickness sensor for detecting a thickness of an article fed into said shredder, and issuing a thickness-detecting signal according to said thickness of said article;

a speed-variable motor operated at a first rotating speed or a second rotating speed, thereby providing motive power to said shredder;

a controlling module electrically connected to said speed-variable motor and said thickness sensor, and including a first look-up table, wherein when said thickness-detecting signal is received by said controlling module, a motor frequency value and a motor voltage value corresponding to said thickness-detecting signal are searched from said first look-up table and outputted from said controlling module to said speed-variable motor, so that said speed-variable motor is controlled to be operated at said first rotating speed or said second rotating speed according to said motor frequency value and said motor voltage value; and a mode-switching element, which is manipulated to switch said shredder between a first mode and a second mode, wherein said controlling module includes a second look-up table corresponding to said second mode, and said second look-up table includes a preset motor frequency value and a preset motor voltage value corresponding to said thickness-detecting signal, wherein if said shredder is switched to said second mode, said controlling module outputs said preset motor frequency value and said preset motor voltage value to said speed-variable motor by referring to said second look-up table, so that said speed-variable motor is operated at a preset motor rotating speed.

2. The variable frequency controlling system according to claim 1 wherein said first look-up table includes a first thickness value and a first motor frequency value and a first motor voltage value corresponding to said first thickness value, wherein if said thickness of said article is equal to said first thickness value, said controlling module outputs said first motor frequency value and said first motor voltage value corresponding to said first thickness value to said speed-variable motor, so that said speed-variable motor is operated at a first motor rotating speed corresponding to said first thickness value.

3. The variable frequency controlling system according to claim 2 wherein said first look-up table includes a second thickness value and a second motor frequency value and a second motor voltage value corresponding to said second thickness value, wherein if said thickness of said article is equal to said second thickness value, said controlling module outputs said second motor frequency value and said second motor voltage value corresponding to said second thickness value to said speed-variable motor, so that said speed-variable motor is operated at a second motor rotating speed corresponding to said second thickness value.

4. The variable frequency controlling system according to claim 3 wherein said second thickness value is larger than said first thickness value, and said second motor rotating speed is smaller than said first motor rotating speed.

5. The variable frequency controlling system according to claim 2 wherein said controlling module further comprises:

a variable frequency unit electrically connected to an AC power source for receiving AC electricity from said AC power source and changing the frequency and voltage of said AC electricity; and a controlling unit electrically connected to said variable frequency unit and said thickness sensor for receiving said thickness-detecting signal, wherein when said thickness-detecting signal is received by said controlling unit, said first motor frequency value and said second motor voltage value corresponding to said thickness-detecting signal are searched from said first look-up table and outputted from said controlling unit to said variable frequency unit.

6. The variable frequency controlling system according to claim 5 wherein by said variable frequency unit, said AC electricity is converted into DC electricity, and said DC electricity is converted into three-phase AC electricity, wherein a frequency of said three-phase AC electricity is equal to said first motor frequency value, and a voltage of said three-phase AC electricity is equal to said first motor voltage value.

7. The variable frequency controlling system according to claim 1 further comprising a motor monitoring module electrically connected to said controlling module and said speed-variable motor for monitor performance of said speed-variable motor, wherein said motor monitoring module comprises:

a temperature sensor for detecting an actual temperature of said speed-variable motor;

a rotating speed sensor for detecting an actual rotating speed of said speed-variable motor; and a current sensor for detecting an actual current of said speed-variable motor.

8. The variable frequency controlling system according to claim 7 wherein if a predetermined operating speed of said speed-variable motor is controlled to be equal to said first motor rotating speed value but said actual operating speed of said speed-variable motor detected by said rotating speed sensor is larger or smaller than said first motor rotating speed value, said rotating speed sensor issues a rotating speed compensating signal to said controlling module so as to decrease or increase said actual operating speed of said speed-variable motor.

9. The variable frequency controlling system according to claim 8 wherein said first motor rotating speed value is listed in said first look-up table.

10. The variable frequency controlling system according to claim 7 wherein said current sensor has a permissible error, wherein if a predetermined current of said speed-variable motor is controlled to be equal to a first motor current value but the difference between said actual current of said speed-variable motor detected by said current sensor and said first motor current value is larger than said permissible error, said current sensor issues a current detecting signal to warn a user.

11. The variable frequency controlling system according to claim 10 wherein said first motor current value is listed in said first look-up table.

12. The variable frequency controlling system according to claim 7 wherein if said actual temperature of said speed-variable motor is larger or equal to a predetermined temperature value, said temperature sensor issues a disabling signal to said controlling module, and said speed-variable motor is disabled under control of said controlling module in response to said disabling signal.

13. The variable frequency controlling system according to claim 1 further comprising a feeding-article sensor connected to said controlling module for detecting whether said article is fed into said shredder, wherein when said article is fed into said shredder, said feeding-article sensor issues an initiating signal to said controlling module, and said controlling module starts to receive said thickness-detecting signal from said thickness sensor in response to said initiating signal.

14. The variable frequency controlling system according to claim 1 wherein said first mode is a power-saving mode, and said second mode is a high-speed mode, wherein a first preset motor frequency value, a first preset motor voltage value and a first preset motor rotating speed corresponding to said high-speed mode are respectively a first high-speed motor frequency value, a first high-speed motor voltage value and a first high-speed motor rotating speed, wherein said first motor voltage value is smaller than said first high-speed motor voltage value.

15. The variable frequency controlling system according to claim 1 wherein said first mode is a power-saving mode, and said second mode is a silent mode, wherein a first preset motor frequency value, a first preset motor voltage value and a first preset motor rotating speed corresponding to said silent mode are respectively a first silent motor frequency value, a first silent motor voltage value and a first silent motor rotating speed, where said first motor voltage value is larger than said first silent motor voltage value.

16. The variable frequency controlling system according to claim 1 wherein said first mode is a high-speed mode, and said second mode is a silent mode, wherein a first motor frequency value, a first motor voltage value and a first motor rotating speed corresponding to said high-speed mode are respectively a first high-speed motor frequency value, a first high-speed motor voltage value and a first high-speed motor rotating speed, wherein a first preset motor frequency value, a first preset motor voltage value and a first preset motor rotating speed corresponding to said silent mode are respectively a first silent motor frequency value, a first silent motor voltage value and a first silent motor rotating speed, wherein said first high-speed motor rotating speed is larger than said first silent motor rotating speed.

17. The variable frequency controlling system according to claim 1 wherein said mode-switching element is switched from said first mode or said second mode to a third mode, said first mode is a power-saving mode, said second mode is a high-speed mode, and said third mode is a silent mode, wherein a first preset motor frequency value, a first preset motor voltage value and a first preset motor rotating speed corresponding to said high-speed mode are respectively a first high-speed motor frequency value, a first high-speed motor voltage value and a first high-speed motor rotating speed, wherein a first preset motor frequency value, a first preset motor voltage value and a first preset motor rotating speed corresponding to said silent mode are respectively a first silent motor frequency value, a first silent motor voltage value and a first silent motor rotating speed, wherein said first silent motor rotating speed is smaller than said first motor rotating speed, and said first motor rotating speed is smaller than said first high-speed motor rotating speed.

* * * * *